US008183451B1

(12) United States Patent
Panaiotis

(10) Patent No.: US 8,183,451 B1
(45) Date of Patent: May 22, 2012

(54) SYSTEM AND METHODS FOR COMMUNICATING DATA BY TRANSLATING A MONITORED CONDITION TO MUSIC

(75) Inventor: Panaiotis, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 336 days.

(21) Appl. No.: 12/617,312

(22) Filed: Nov. 12, 2009

Related U.S. Application Data

(60) Provisional application No. 61/198,957, filed on Nov. 12, 2008.

(51) Int. Cl.
*G10H 1/00* (2006.01)
*G10H 7/00* (2006.01)

(52) U.S. Cl. ..... 84/601

(58) Field of Classification Search ..... 84/600, 84/601, 411 R, 411 P
See application file for complete search history.

(56) References Cited

U.S. PATENT DOCUMENTS

| | | | | |
|---|---|---|---|---|
| 4,982,643 | A * | 1/1991 | Minamitaka | 84/613 |
| 5,371,854 | A * | 12/1994 | Kramer | 704/270 |
| 6,225,546 | B1 * | 5/2001 | Kraft et al. | 84/609 |
| 6,834,373 | B2 * | 12/2004 | Dieberger | 715/247 |
| 6,897,367 | B2 * | 5/2005 | Leach | 84/609 |
| 7,135,635 | B2 * | 11/2006 | Childs et al. | 84/600 |
| 7,138,575 | B2 * | 11/2006 | Childs et al. | 84/615 |
| 7,304,228 | B2 * | 12/2007 | Bryden et al. | 84/600 |
| 7,396,990 | B2 * | 7/2008 | Lu et al. | 84/611 |
| 7,511,213 | B2 * | 3/2009 | Childs et al. | 84/615 |
| 7,629,528 | B2 * | 12/2009 | Childs et al. | 84/609 |
| 7,674,966 | B1 * | 3/2010 | Pierce | 84/609 |
| 2005/0240396 | A1 * | 10/2005 | Childs et al. | 704/207 |
| 2006/0111621 | A1 * | 5/2006 | Coppi et al. | 600/300 |
| 2006/0247995 | A1 * | 11/2006 | Childs et al. | 705/35 |
| 2009/0000463 | A1 * | 1/2009 | Childs et al. | 84/615 |

OTHER PUBLICATIONS

Arslan, Burak, et al., A Real Time Music Synthesis Environment Driven with Biological Signals, 2006 IEEE International Conference on Acoustics, Speech, and Signal Processing, May 14-19, 2006, p. II-II.

Panaiotis, Vergara V., Sherstyuk A., Kihmm K., Saiki S.M. Jr., Alverson D.C., Caudell T.P. Algorithmically Generated Music Enhances VR Nephron Simulation in Medicine Meets Virtual Reality 14; Accelerating Change in Health Care: Next Medical Toolkit vol. IV Studies in Health Technology and Informatics. IOS Press, Amsterdam, The Netherlands; 2006. pp. 422-427.

Panaiotis, Smith S., Vergara V, Xia S., Caudell T.P, Algorithmically Generated Music Enhances VR Decision Support Tool, Science and Technology for Chem-Bio Information Systems (S&T CBIS) Conference, Oct. 2005.

* cited by examiner

*Primary Examiner* — Jeffrey Donels
(74) *Attorney, Agent, or Firm* — Valauskas Corder LLC

(57) ABSTRACT

A system and methods for continuously communicating data regarding the status of a monitored condition using music, which trained persons can recognize and interpret. One or more data collector devices monitor conditions and provide data regarding the status of the conditions to an analyzing device. The analyzing device receives the data and creates data music that is played on an audio device with reference music establishing the Hierarchal Music Structure (HMS) to the listener. The data music is a musical representation of the data against the reference music, which are played on an audio device.

18 Claims, 5 Drawing Sheets

SYSTEM AND METHODS FOR COMMUNICATING DATA BY TRANSLATING A MONITORED CONDITION TO MUSIC

PRIORITY STATEMENT

This application claims the benefit of U.S. Provisional Application No. 61/198,957 filed Nov. 12, 2008.

STATEMENT CONCERNING FEDERALLY SPONSORED RESEARCH

This invention was made with government support under BOA 0409J-094-2 awarded by Los Alamos National Lab, DTRA01-03-D-0009 TO 1-5 awarded by Defense Threat Reduction Agency, and D1BTH100003 awarded by Health Resources and Services Administration. The government has certain rights in the invention.

FIELD OF THE INVENTION

The present invention is a system and methods to communicate data, and further to continuously communicate data, for example in real-time. More specifically, the present invention is a system and methods to communicate data through music.

BACKGROUND OF THE INVENTION

Improvements in technology have revolutionized the communication of data in many environments, such as business, medical, education, government, security, weather, emergency, transportation and household environments.

Data communication includes conveying information visually and/or aurally. The fact that sound conveys information is often overlooked, but a significant part of daily life and function—examples include: door bells, alarm clocks, timers, alert signals, and recognized tones like the NBC Universal® trio that evoke an association.

More specifically, aurally communicated data, otherwise known as sonification, may include, for example, a sound signal such as an alarm to convey a change in condition, such as current or imminent danger or distress. Sound signals can also convey a range of conditions or variable states.

Numerous examples illustrate the use of a sound signal as a form of data communication. The classic example of sonification is the Geiger counter, which provides a sonic measure of the amount or density of material its sensors detect. Another such example is a smoke detector, which monitors an environment for the presence of smoke. When a monitored condition changes to match a predetermined parameter, i.e., the presence of smoke above a predetermined threshold, the detector generates an alarm. The alarm communicates data to all those present in the environment that smoke and possibly a fire is causing a threatening or unsafe situation. Typically, all smoke detectors generate a similar alarm or sound that everyone comes to associate with a smoke detector. These alarms are usually repetitive, loud, and persistent, for example, a constant high pitched electronic sound, a warbling sound, or a beeping sound. Their intention is to cause a fight-or-flight response, which may cause a person to flee or attempt to eliminate the danger. However, they may also cause panic or irrational behavior.

Numerous examples also exist that illustrate a visual signal as a form of data communication. One such example is a beacon or a light bar on an emergency vehicle, which communicates data to all those present in the environment that there is an emergency situation. Typically, beacons or light bars alert members of the public, either as they approach the vehicle, or it approaches them.

Data is usually communicated based on a change in a condition. When a condition changes to match a predetermined parameter, a sound signal and/or visual signal may be generated. Typically, a sound signal and/or visual signal are generated in response to only one change in condition, e.g., on or off, and are considered unsophisticated in the respect of communicating data continuously to convey all changes occurring in a condition that is being monitored. Several types of devices and systems are known that monitor conditions for changes.

One such example is a security system that utilizes sensors to monitor conditions, for example the status of doors and windows such as locked/unlocked. When a monitored condition changes to match a predetermined parameter, i.e., a door becomes unlocked, a sound signal such as a siren is generated by the sensor. The siren communicates data to all those present in the environment that an intruder may be nearby.

Another example is a portable device that monitors conditions of the device itself. Data communication includes a sound signal generated by the portable device to communicate a change in condition, for example a ring tone to communicate an incoming call.

Other examples of communicating data relating to a change in condition, or a range of condition values, include monitoring the status of patients in a hospital, or the status of electrical equipment or machinery such as vehicles, computers, computer networks or industrial equipment employed in power plants or manufacturing plants, to name a few.

Present day sound signals and visual signals that communicate data are typically received and interpreted by all persons in the vicinity of the signal. Some signals, by their very nature, are designed to raise awareness by being distinctive and not blending in with the surrounding environment.

In environments that have many monitoring devices, such as a patient intensive care unit, sonic output of the various devices are not coordinated. They tend to be alarming, annoying, and cacophonous.

Music impacts mood, atmosphere, and energy. Too often informational sounds and music compete with each other. In a commercial setting the inventory control alert that is used in many stores is loud and disturbing and conflicts with the desire to make customers feel comfortable and encourage them to remain. This invention bridges the gap between the need to know certain information while providing a satisfying or comfortable environmental experience.

There is a demand for a system and methods of communicating data regarding the status of one or more monitored condition using sound signals that only certain persons recognize and interpret. Additionally, there is a demand for a system and methods of communicating data in a coordinated or harmonious system. Additionally, there is a demand for a system and methods of communicating data that considers the psychological impact of the environment and thus encodes the data musically. The present invention satisfies these demands.

SUMMARY OF THE INVENTION

The present invention combines information or data with music to create a unique interaction. The music is created in real-time by a sophisticated computer system. The music can incorporate information recognizable and interpretable by one party—i.e. employees—while transparent to another party—i.e. clientele. Input of information or data from security or medical systems can be channeled into music and conveyed to staff without removing their attention from the task at hand, or increasing stress and noise levels as with traditional beeping or alarm tones. The invention is even applicable to video games where the music can be used to convey information to the players while maintaining the realistic environment that has been so painstakingly created.

The present invention is applicable in a wide variety of applications, for example, shopping and dining environments, manufacturing settings, security monitoring, medical facilities, and even video games as mentioned above.

The present invention is a system and methods for communicating data musically pertaining to the status of one or more monitored conditions using sound signals, or music, which trained persons recognize and interpret. The term "listener" used herein is a person trained to recognize and interpret. More specifically, a listener analyzes the data music.

The present invention analyzes data related to or from one or more monitored conditions, communicates the data in a musical form and in so doing, provides a listener with information related to the status of the one or more monitored conditions.

A data collector device monitors one or more target conditions or a range of conditions to obtain data. It is contemplated that data can include pre-stored data such as a database or graphic image, or output of a monitoring device such as a sensor. Conditions include people, places, and things and may be for example, environmental conditions, physical conditions, medical conditions, operating conditions, social conditions, cultural conditions, computer conditions, equipment conditions, to name a few. It is contemplated that a monitored condition may include a plurality of monitored conditions or a system of monitored conditions. Furthermore, a plurality of monitored conditions or a system of monitored conditions may be related or not related. The monitored condition may be, for example, time, temperature, human behavior, noise, health functionality of a patient or group of patients.

Data collector devices include, for example, detectors, sensors, cameras, monitoring elements, instrumental data feeds, or computers. The collector device continuously or periodically monitors the target condition and provides data from the condition to an analyzing device. For pre-recorded data, the data collector device regulates the reading of the data as it sends it to the analyzing device.

For purposes of this application, the terms "data" and "information" may be used interchangeably herein and relate to constraints, controls, communications, instructions, knowledge, patterns, measurements, values or variables, to name a few.

The analyzing device determines changes in the status of the monitored conditions. The analyzing device includes well-defined instructions to analyze data received from the data collector device. The well-defined instructions may be in the form of an equation, algorithm, or pre-defined parameters such as a threshold. In one embodiment of the present invention, the instructions are in the form of an algorithm that includes pre-defined parameters. Data related to the monitored condition is analyzed with respect to the pre-defined parameters. It is also contemplated that the analyzing device may include an equation that analyzes data with respect to previously received data from the monitored condition thereby detecting and conveying changes occurring in the data.

A Hierarchal Music Structure ("HMS") device provides a Hierarchal Music Structure ("HMS"), which includes reference music parameters, otherwise referred to herein as HMS parameters. The HMS parameters are musical or sound parameters that define what is termed herein as "reference music." In other words, the reference music is the sonic realization of the HMS. The generated music—that includes reference music and data music—can use the HMS as a reference against which the data can be measured to convey the status of at least one monitored condition.

The music generator device combines the reference music and data music to produce generated music. The generated music musically communicates the changing, steady state, or ongoing status of at least one monitored condition by modifying the reference music and/or data music in any of a number of ways.

The music generator device encodes the data in a musical environment to provide "data music". Data music is the additional musical components that represent the data against the reference music. The analyzed data is communicated musically, either within the subject environment or at a remote environment, to continuously convey the status of at least one monitored condition in real-time. A music generator device translates the data into a musical context and communicates the analyzed data by altering or modifying musical sound parameters according to the HMS. The parameters of the HMS establish a baseline, or a specific musical structure. The HMS parameters may be predefined with respect to one or more sound parameters, such as pitch, rhythm, loudness, space, and/or timbre. When there is a change to the definition of the HMS, there is also a modification to at least one reference music parameter. It is contemplated that certain reference music parameters may undergo cyclic changes according to regular cycles or periodic long-term cycles, for example time of day, that may redefine the HMS.

Pitch is determined by elements of frequency, notes, and scale, whereas rhythm is determined by elements of time, tempo, and meter. Loudness is determined by intensity of sound energy. Timbre is determined by the quality (color) of the sound source, which includes noises and pitched and non-pitched instruments.

While it is recognized these fundamental parameters are interrelated, they may also be treated and manipulated separately. It is also recognized that any audible sound has the potential of being included in a musical context. The present invention contemplates the notion of "music" in a well-defined HMS of at least one of the basic parameters: pitch, rhythm, loudness, timbre, or space (location). Broader levels of hierarchy are possible, for example, harmony and musical phrase. Smaller levels are also possible such as beat subdivisions and scale tuning. Other sound parameters are also included, such as spatial considerations and noise-bands.

Pitch is the height or depth of a sound relative to frequency of air pressure fluctuation. Pitch may be discrete and singly defined (as in a flute playing a high C), or diffuse (as in a small gong or piccolo snare drum).

Scale is a collection of discrete pitches derived from a pattern of ascending and/or descending intervals (distance between pitches). A scale typically defines pitches within an octave (base frequency times 2) and is repeated every audible octave to cover much of the auditory hearing range. Scale can be used to define a pitch hierarchy.

Scale tuning is the precise mapping of frequency to pitch for each scale member. Some examples include equal-tempered and just-intonation scale tuning.

Notes are musical tones or distinct sonic events. Notes may be pitched or non-pitched. Each note has a finite duration.

Meter is the cyclic pattern of stressed and unstressed beats and subdivisions of beats at definite (and typically regular) time intervals.

Measures mark the temporal space between each time cycle designated by the meter.

Time signatures describe the rhythmic duration and the stress hierarchy within the measure—it defines the meter. Examples include six-eight time or three-four time. The difference between these two examples, each of which have six eighth-notes in a measure, is that the former establishes a stress hierarchy of two groups of three, and the latter establishes a stress hierarchy of three groups of two.

Rhythm is the pattern and stress of change over time. Any sound component (pitch, loudness, or timbre) can make a change and consequently establish the rhythm.

Tempo is the rate of speed through which a measure is played.

Timbre is determined by color of instruments and instrument combinations, and quality of sound source (noises and instruments).

Space is the perceived location of the sound source. It may be monotonic, or it may move. It may also be distributed in many locations or move in patterns. The qualities of the space (large, small, resonant and dry) are also spatial parameters.

The sounds used in the contemplated system may be generated by the generator device using any technique available to make the sounds. They include current technology, such as various synthesis techniques including AM, FM, waveshaping, granular synthesis, sampling, and physical modeling, to name some current techniques. Sampled sounds include any recordable sound, either instrumental (flute, drum, organ, piano, singer, etc.), or environmental (bird chirp, train, plane, scream, etc.). It is contemplated that the present invention may also include these sampled sounds as appropriate.

An audio device may be defined as any device or functions embedded in composite devices that are used to manipulate audio, voice or sound-related functionality. It includes audio data—analog or digital—and the functionality used to control the audio environment such as volume and tone controls. In addition to one or more output elements such as microphones, speakers, headsets and music players, audio devices may include one or more input elements such as a microphone to record music or receive voice commands.

A storage device records and/or stores information. According to the present invention, the storage device may record and/or store the reference music and data music, and may further process the information, for example to generate summary reports, such as whether or not an emergency situation was handled in a timely manner.

HMS is based on a hierarchy or categorization that is an established means of conveying music and may additionally act as a reference grid against which data can be measured. For example, in the pitch domain, the hierarchy might be denoted by a scale in which one note (pitch class) is supreme. Other pitches within the scale may have secondary or tertiary meaning within the hierarchy. Notes outside the scale could additionally carry special meaning. The hierarchy may establish either a linear or non-linear mapping. For example, in a linear mapping, measurement might be directly related to the scale degree of a note against the tonic (scale key center). In another embodiment, the hierarchy may be non-linear such that the precedence or measurement may be related to functional hierarchy, such as tonic, dominant relationships.

Rhythmically, a hierarchy can be established by quantizing events to a time cycle (meter). Each meter (time signature) establishes a predefined hierarchy of levels of stressed and unstressed events. Playing events outside the hierarchically quantized time structure may carry additional special meaning. Like pitch, the hierarchy can be linear or non-linear.

Changes in the at least one monitored condition are communicated musically by modifying the music relative to the HMS, or by changing the HMS definition. Several ways to communicate data using the HMS are contemplated. Examples include: (1) a musical element that adheres to the HMS can be added to the generated reference music—such an addition may provide additional or measured information by the nature of its inclusion, for example, a melody having predominately ascending pitch intervals in cycles of four notes; (2) a musical element can be removed from the generated reference music, for example removing all percussion, thereby signaling a particular condition; (3) a musical element can provide information by playing against or in contrast to the HMS—this will tend to stand out sharply, for example, an added melody that plays in a different meter or tempo than the reference, or plays pitches outside the scale; and (4) status of a condition can also be conveyed by changing the HMS definition itself, for example, changing the reference meter or scale, or changing the tempo or scale tuning system.

There are two layers of music: reference music that is pre-established and data music that is placed on the reference music, which is used as a measure or guide for the data music. Therefore, the music hierarchical structure acts as a grid in time and frequency space, and the data music plays against it. The reference music is generally static, or passive, while the overlaying data music is active and changes according to the data.

Users trained to recognize the modifications in the music interpret the modifications as specific changes in the monitored condition. Individuals not trained or capable of recognizing modifications in the music and interpreting the modifications from the music are merely bystanders who can simply enjoy the music playing.

An example is a security guard who hears a melody that is "jazzed up" because it is playing counter to the established rhythmic stress hierarchy. The guard knows, because it is syncopated, that a security breach has been made. The instrument playing the melody is an oboe, so the guard also knows that significant metal was detected such as possibly armed intruders. The prominent spatial direction and pattern of music indicates which door has been breached. The music changes to ¾ time, so the guard knows that three people were detected entering the building. The melodic pitch content focuses on the 5th scale degree, so the guard knows that all the persons are of average height and weight. The tempo speeds up, so the guard knows they are (or were) moving fast, maybe running. Those not trained to recognize and interpret modifications in the music are unaware of changes to the status of a condition and simply enjoy the music.

As another example, trained hospital staff may recognize a modification in tempo in the HMS to interpret the music being played as a patient has flat-lined or needs emergency assistance. There are numerous applications contemplated according to the present invention. The data is communicated as music to "silently" inform a trained user of the status of the monitored condition.

In one embodiment, it is contemplated that the data can be measured by mapping the data as music components relative to the reference music that establishes the HMS to provide a musical reference grid against which comparisons are made. For example, data can be mapped as time and pitch music parameters according to the HMS. This data music can serve as a reference to subsequent mapped data in order to measure or compare the data.

The present invention is best understood as an application of music to create the equivalent of graph paper in the time and frequency domain by which data music is measured against. In one embodiment, rhythm and meter create the vertical lines that represent gridlines along the horizontal axis, for example, metric emphasis corresponds to heavier and lighter lines along the horizontal axis. Pitch and scale create the horizontal lines that represent gridlines along the vertical axis, for example, key center and harmonic pitch hierarchy correspond to thicker and thinner lines along the vertical axis. This grid is then used as a reference against which the other data is sounded and music is the context by which the data is measured.

It is also contemplated that the music, including data, can be recorded. This allows a trained user who knows the instructions—such as equation, algorithm or pre-defined parameters—by which the data has been translated to extract the data from the music at a later time.

An object of the present invention is to continuously communicate data through music. Necessary information is communicated without adding to noise pollution or stress.

Another object of the present invention is to musically communicate data in real-time.

Another object of the present invention is to musically communicate data pertaining to a condition that is monitored for changes, i.e., the continuous status of the monitored condition.

Another object of the present invention is to generate music based on a HMS so that trained users of the present invention can recognize modifications in the music and interpret the modifications as specific changes in monitored condition. The present invention advises a trained user of the changing, steady state, or ongoing status of monitored conditions.

Yet another object of the present invention is to allow a user to define the sound components of the HMS.

Another object of the present invention is to measure data pertaining to conditions that are monitored for changes.

Another object of the present invention allows people to remain focused while receiving critical information Yet another object of the present invention is to record the music generated such that it can be interpreted at a later time.

The present invention and its attributes and advantages will be further understood and appreciated with reference to the detailed description below of presently contemplated embodiments, taken in conjunction with the accompanying drawings.

BRIEF DESCRIPTION OF THE DRAWINGS

The subject matter of the invention is explained herein below with reference to exemplary embodiments in accordance with the present invention and illustrated in the attached drawings.

DETAILED DESCRIPTION OF EMBODIMENTS OF THE INVENTION

The present invention is a system and methods for musically communicating data regarding the continuous status of a monitored condition using music that certain persons can recognize and interpret. The present invention contemplates the communication of data in many environments, for example, business, medical, education, government, security, weather, emergency, transportation and household environments.

Figure 1:
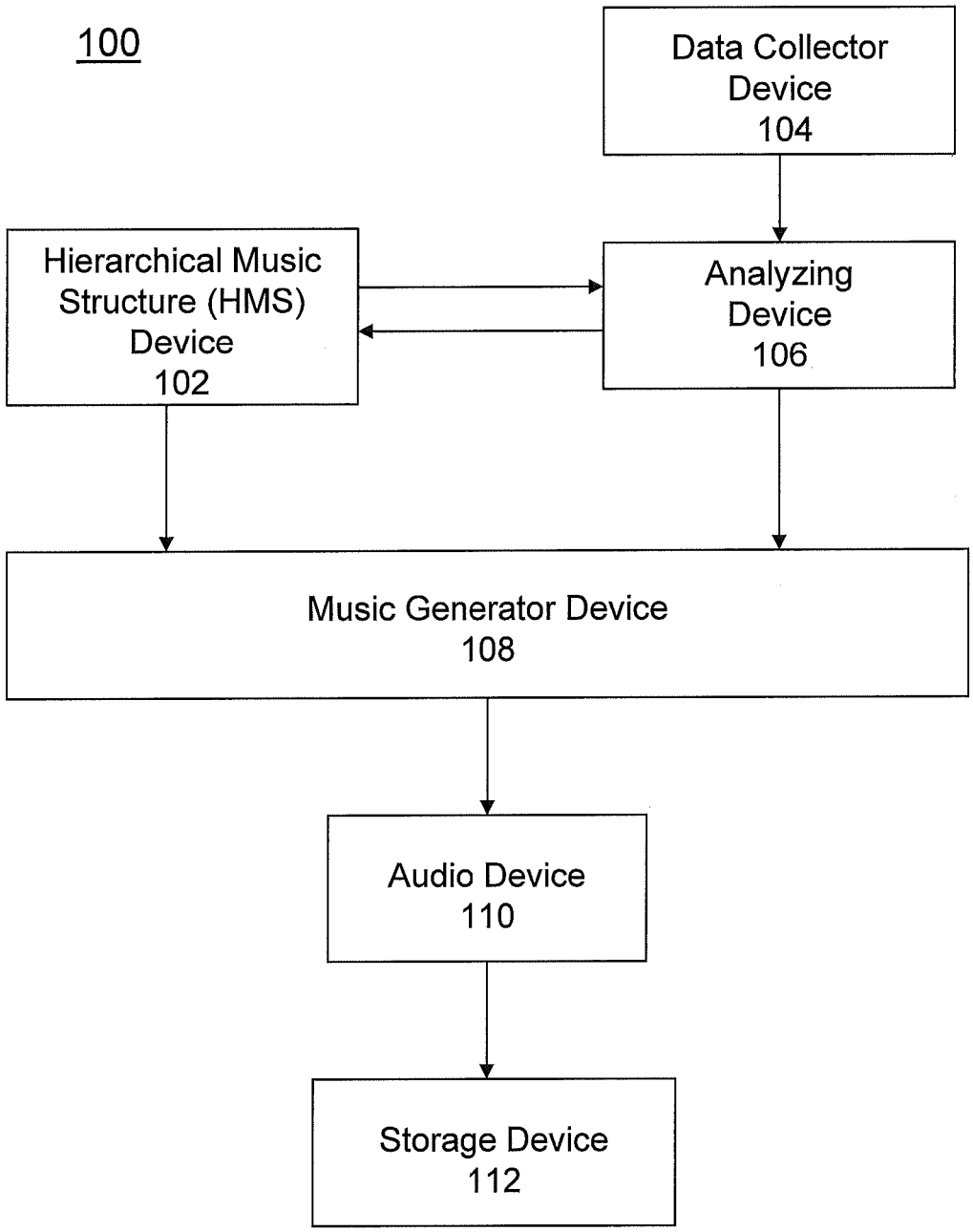
FIG. 1 is a system flow chart of one embodiment according to the present invention.

FIG. 1 illustrates a system 100 according to one embodiment of the present invention that analyzes data related to a monitored condition, communicates the data in a musical form and in so doing, provides certain users with information related to the status of the monitored condition.

The system 100 according to the present invention includes a Hierarchical Music Structure (HMS) device 102 that specifies the HMS parameters or sound parameters in order to define what is considered by listeners as "normal" musical behavior for the environment. The HMS parameters are specified in order to designate the HMS definition.

A data collector device 104 monitors conditions to obtain data or information which is forwarded to the analyzing device 106. In one example, the data collector device 104 may be a sensor that monitors the medical condition of a patient, for example, heart rate after open-heart surgery.

In addition to the data collector device 104 feeding data to the analyzing device 106, the HMS parameters of the HMS device 102 are also delivered to the analyzing device 106. The analyzing device 106 analyzes the HMS parameters from the HMS device 102 as well as the data from the data collector device 104. The analyzing device 106 includes well-defined instructions to analyze parameters received from the HMS device 102 and data or information received from the data collector device 104. Based on the analysis, changes in parameters of the HMS definition may be determined, data music elements may be established, or HMS components may be modified.

The music generator device 108 combines the reference music and the data music. The generated music is played within the environment on an audio device 110. The data music is heard and understood by a trained user while the general public enjoys the discreetly playing music, which is the reference music and further may include data music.

In addition, the music—either the reference music, data music, or both—may be recorded and/or stored within a storage device 112. A database may be created of all the recorded and/or stored music for manipulation and examination.

As just one example of the present invention in a hospital environment, the HMS device 102 specifies the HMS parameters in order to define what is considered by listeners as "normal" musical behavior for medical personnel, patients and visitors. The HMS parameters are specified in order to designate the HMS definition. The music generator device 108 characterizes and generates the reference music that is played on the audio device 110.

In the situation where a patient is being monitored, for example a patient that underwent open-heart surgery, a data collector device 104 such as a sensor is monitoring the patient's heart rate. The heart rate of the patient obtained by the data collector device 104 is sent to the analyzing device 106.

The instructions of the analyzing device 106 include an algorithm that defines a threshold to analyze the heart rate of the patient received from the data collector device 104. For example, the algorithm of the analyzing device 106 includes a threshold of 40 beats-per-minute for the heart rate.

A music generator device 108 generates the data music and musically communicates the data by generating the combined reference music and data music to play on an audio device 110 in the hospital environment. For example, if the heart rate of the patient drops below the pre-defined threshold of 40 beats-per-minute, the data music representing the heart rate is played in conjunction with the reference music. Trained medical personnel recognize the modification in the music and interpret the modification as a drop in the heart rate of a patient below 40 beats-per-minute. Individuals not trained or capable of recognizing modifications in the music are merely bystanders that can simply enjoy the music playing, which, in the case of an intensive care unit, can be therapeutic. Thus, the data is communicated as music to musically inform a trained user of the status of the patient.

It is also contemplated that the data can be recorded and stored on a storage device 112 for later use. Recorded and stored data allows a trained user who knows the instructions by which the data has been translated to extract the data from the music at a later time.

Figure 2:
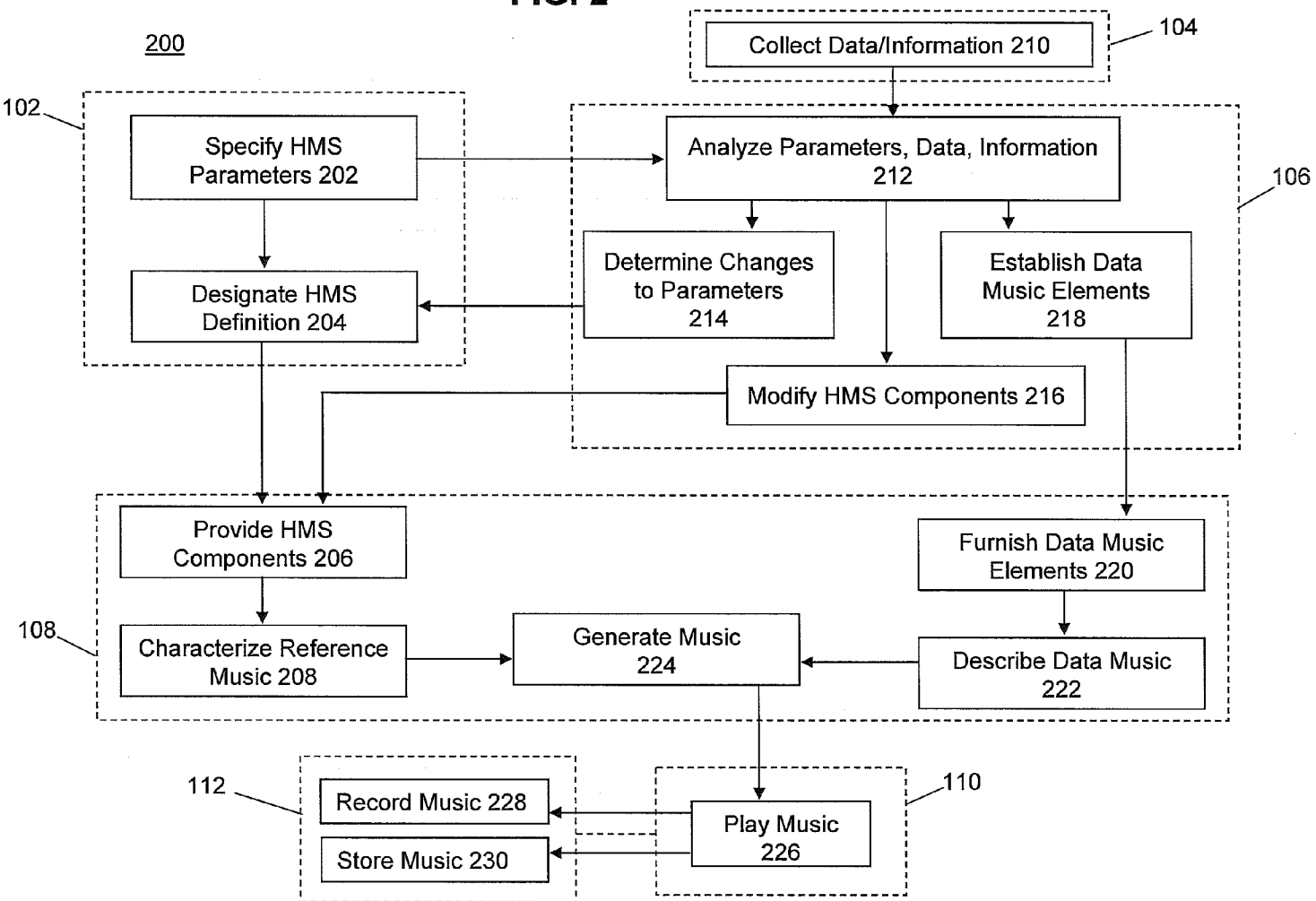
FIG. 2 is a method flow chart of one embodiment according to the present invention.

FIG. 2 illustrates the method 200 according to the present invention described with respect to a security environment in a building, but as mentioned above, the present invention contemplates communicating data in many environments.

HMS parameters or sound parameters are specified at step 202. The parameters are defined in order to define what is considered by listeners as "normal" musical behavior for the environment. The HMS parameters are supplied or fed into the HMS definition to designate "reference music". Parameters include, for example, key center, time, scale, meter, pitch, rhythm, timbre, tempo, beats, measure, meter, notes, loudness, and space, and with respect to larger music parameters such as harmony and phrase, as well as sonic parameters such as frequency adjustments, among others.

The HMS parameters of step 202 are specified in order to designate the HMS definition at step 204. The HMS parameters are also delivered to an analyzing device for reasons described more fully below.

HMS components are provided at step 206, which are governed by the HMS definition designated at step 204. HMS components may be the same or different than the HMS parameters described above and may include, for example, key center parameters, time, scale, meter, pitch, rhythm, timbre, tempo, beats, measure, meter, notes, loudness, space, harmony, phrase, and frequency. The HMS musical components at step 206 characterize the reference music at step 208. This reference music is generated at step 224 and played at step 226 on an audio device. The reference music is heard by listeners and considered "normal" musical behavior for the environment.

The reference music may also be recorded at step 228 and/or stored at step 230. For example, the reference music can be stored in a database. The data within the database can be accessed and manipulated for any number of contemplated reasons, such as to generate various reports.

Under normal conditions, periodic changes to the fundamental HMS parameters of step 202 may occur for variety in the music. The security team will know that these changes do not have special meaning. It is also possible that the HMS definition at step 204 can be changed by unimportant conditions, like outside temperature, or non-security door or elevator activity. These conditions as well as other data described more fully below, are collected at step 210 and fed to the analyzing device.

As an example, time defines the established key center of the designated HMS definition at step 204 and the analyzing device receives time information from the data collector at step 210, this information is analyzed at step 212 and time-oriented changes are determined at step 214 such that the HMS key center parameter is changed to designate the HMS definition at step 204.

As another example, door activity data is used such as an open door condition and a closed door condition, the data is collected at step 210 and sent to the analyzing device. The analyzing device analyzes the data at step 212 and determines data music elements at step 218, which may be represented in one of the data music components at step 220.

The data collector device monitors a condition, such as whether an unauthorized person has entered the building. The data collector device continuously collects data at step 210. If a security issue arises—such as an unauthorized person has entered the building—the data collector device 210 collects and sends the data to the analyzing device. The analyzing device determines a factor value to indicate a security breach such that one or more of the following could take place: (1) the analyzing device changes one or more parameters at step 214, such as meter, of the HMS definition of step 204; (2) the analyzing device modifies—such as adding or deleting—one or more components at step 216 which modifies the HMS components at step 206 which, in turn, characterizes the reference music at step 208; (3) the analyzing device modifies—here, removes—one or more trivial elements at step 218 of the data music elements of step 220, e.g., those representing non-security door activity, in order to describe non-security related data as data music at step 222; (4) the analyzing device modifies—here, adds—one or more elements at step 218 of the data music elements of step 220 to describe security related data as data music at step 222.

The reference music of step 208 is combined with the data music of step 222 and generated at step 224. The generated music of step 224 is played within the environment at step 226 on an audio device. The reference music plays throughout the building and a security guard, i.e., the trained user, recognizes and interprets the data music, or modifications to the reference music such as a change in pitch, and can act accordingly, such as approaching the unauthorized person.

The data music of step 222 is heard and understood by the security personnel while the general public enjoys the discreetly playing music. Thus, the entrance of the unauthorized person is "silently" communicated to the security guard.

In addition, the music—either the reference music, data music, or both—may be recorded at step 228 or stored at step 230. The record and/or storage of the music can be used for later analysis, including the analysis of how the security personnel responded to the situation.

As mentioned above, the hierarchical musical structure acts like a grid of horizontal and vertical components. The reference music is carefully planned, but can be adjusted for different contexts. Data music is measured against the structured reference music or is aligned with it for aesthetics. It is also contemplated that the data music can drive, influence, and create the reference music. So the reference music itself can be dynamically altered according to the collected data or information.

Figure 3:
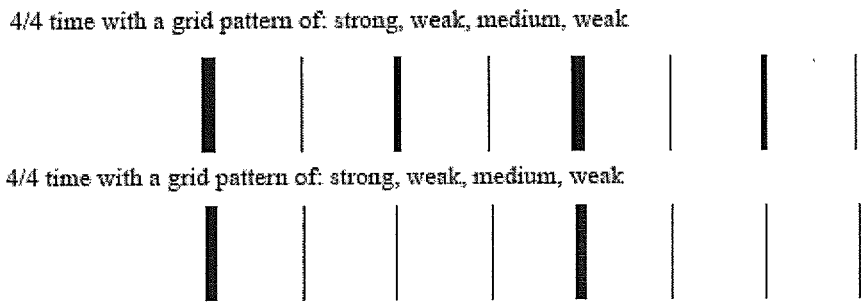
FIG. 3 is a graphic representation of gridlines along the time domain according to one embodiment of the present invention.

In one embodiment, the gridlines of the reference music along the time domain are marked by music with a steady pulse. In this example, 4/4 time has a cyclic beat pattern of "strong-weak-medium-weak, or strong-weak-weak-weak"

as shown in FIG. 3. Data music that falls along or between the gridlines of the reference music can provide data or information. For example, on the pitch grid, the scale is used as the basis for a grid system in the frequency domain. In some contexts, data music will always be heard on one of the gridlines (scale members). However, data music can be heard and measured when it falls on or between the gridlines.

Figure 4:
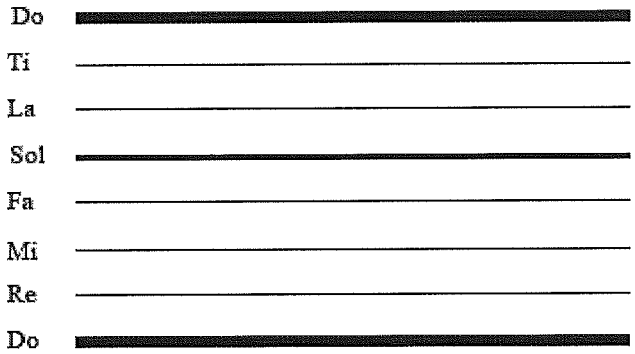
FIG. 4 is a graphic representation of gridlines along the frequency domain according to one embodiment of the present invention.

Unlike the time domain, which can closely resemble the gridline analogy of equally spaced vertical lines, the use of pitch and scale to represent a vertical (orthogonal axis) as shown in FIG. 4 has some peculiar properties that will need special consideration.

Figure 5:
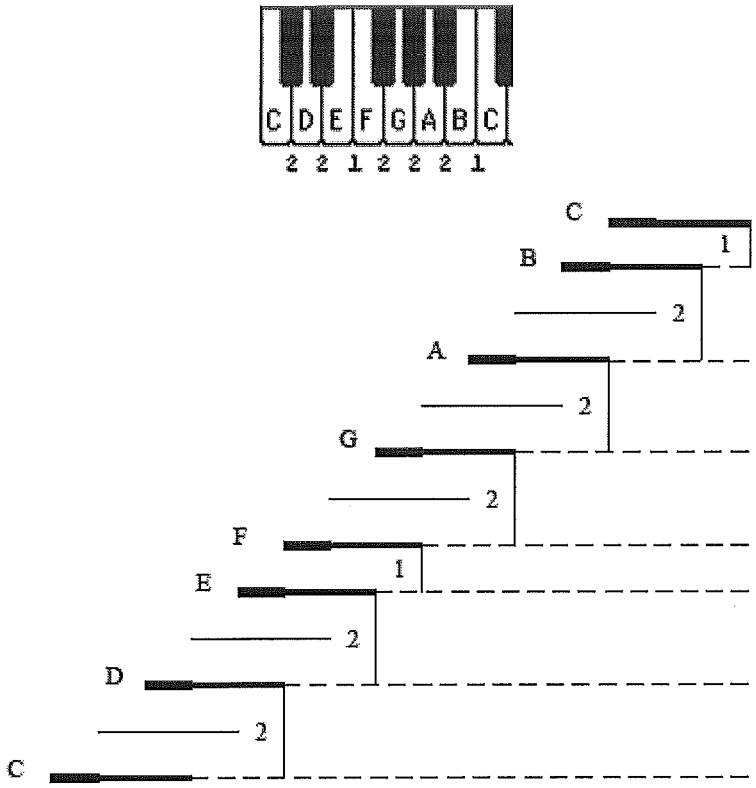
FIG. 5 is a graphic representation of a pattern of interval scale structure of semitones according to one embodiment of the present invention.

Time is generally experienced linearly, especially in short intervals such as seconds. The pitch domain is non-linear in two respects. First, the "linear" perception of pitch follows an exponential frequency curve such that the difference between 200 Hz and 400 Hz is heard the same as the difference between 400 Hz and 800 Hz. Each doubling of the frequency corresponds to an advancement of one pitch register, or octave. Second, the perception of scale-wise motion (change of pitch step-by-step) for a diatonic scale may actually represent different frequency interval ratios. This difference may be microtonal when a scale is not tuned in the Western equal-tempered system, or semi-tonal, when considering different scale patterns and scale modes. The perception of "one step" of a scale may represent different intervals depending on the scale interval structure and where the step occurs in that structure. For example, the C-major scale has an interval scale structure of semitones in the pattern: <2 2 1 2 2 2 1>. This corresponds to the white notes on the piano starting on the pitch class 'C'. Each '2' represents two semitones, and in this case, there is a black key between white keys where there is a '2', and no black key between the white keys where this is a '1'. A graphic representation of this scale-wise semitone interval pattern is seen at FIG. 5. Therefore, the present invention takes this into consideration.

Unlike the visual grid space, the sonic grid space can be clearer if only partially represented. While not necessarily true in the rhythm (time) domain, it is especially true in the pitch (frequency) domain. In the pitch (frequency) domain, the perception of pitch class octave equivalence spans multiple octaves, which means that hearing a pitch in one octave provides the reference for all octaves—within a range that is practical for pitch class recognition or pitches within the frequency range of about 32 Hz to 5,000 Hz.

To a lesser degree, harmonic/acoustic sounds are actually multiple pitched structures with harmonic overtones that provide pitches higher than the fundamental, and for which the stronger of these will generally be along higher grid points. The other factor that makes it possible for the grid lines to be implicit and not always present is that the sense of rhythm creates an expectation that is fairly accurate along the time axis. It is therefore possible that some "grid points" along the time domain can be missing, but it can still be discerned when something does not fall along that line. So, too, along the pitch axis. For example, when a music texture that establishes or implies a scale is heard, an expectation of where pitches should be heard is built, i.e., an expectation grid that does not have to be ever present.

Figure 6:
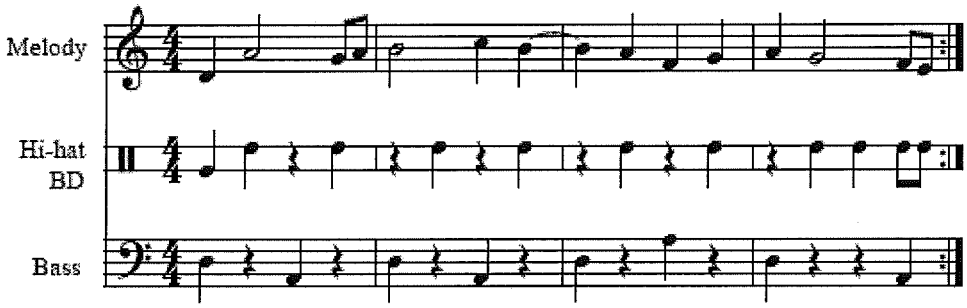
FIG. 6 is a graphic representation of gridlines along the frequency domain according to one embodiment of the present invention.

FIG. 6 shows a grid music sketch. While the temporal grid is established, the pitch grid is incomplete since it only plays the tonic and dominant, leaving the rest of the scale ambiguous. The ambiguity can be resolved two ways: a musical line that establishes the rest of the scale can be added or the incoming data to fill in the scale can be allowed.

As shown in FIG. 6, the top line melody along with the bass line establish the pitch grid with 'D' as the tonic (correlating to a thick line in the grid paper analogy), 'A' as the dominant (thinner line, but still hierarchically important) and the scale members that indicate use of a Dorian mode scale.

Once the melody is played, it does not need to be constantly played for the scale grid to be maintained. Instead, scale members only need to be reinforced according to the context of providing a reference to the data. If the data tends to fall on the gridlines, then the reinforcement is unnecessary because the data provides it. If, however, the data requires that notes be played off the grid (outside the Dorian scale) then the scale needs to be aurally reinforced. Once the grid space is defined aurally, data can be mapped onto this system according to the context of the application.

Figure 7:
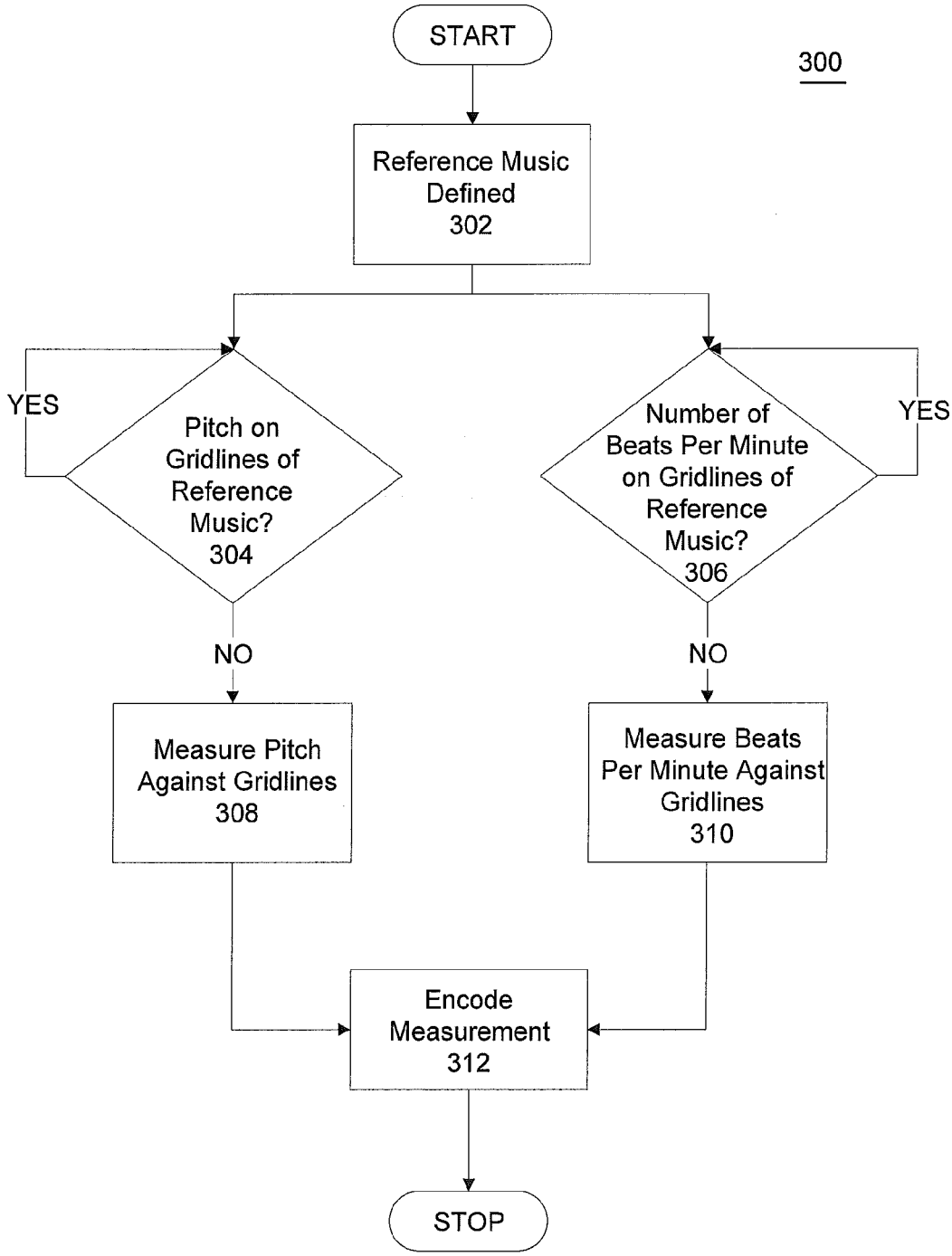
FIG. 7 is a method flow chart of one embodiment of encoding according to the present invention.

FIG. 7 is a method 300 flow chart of one embodiment of encoding as described above according to the present invention. The HMS may be used to encode data using the hierarchy as a means to measure data. This example is meant to demonstrate but not define the means for such measurement.

At step 302 the reference music is defined thereby establishing the HMS to the listener. For example, in the pitch domain, measurement may be drawn when the reference music establishes a particular pitch class as the key center such as 'D'. At step 304, if the pitch is within 'D', then no measurement is taken. A pitch that is not 'D' at step 304, is measured as a distance from 'D' at step 308. This measurement may be numeric, alphanumeric, or represent an item. At step 312, the measurement is encoded. For example, if the pitch was not 'D', but 'E', then in a diatonic context 'E' is one step above 'D' and could represent a number '1', or indicate a selection from a group of items, e.g., 'E'=an orange, 'F'=an apple, etc.

In the time domain, measurement may be represented in many ways: the number of beats in a measure, the number of pulses per beat, the number of music notes distributed over the course of a time period. After the reference music is defined at step 302 to establish the HMS to the listener, then it is determined at step 306 if the number of beats per minute is within the gridlines of the reference music. If the number of beats per minute are not within the gridlines of the reference music at step 306, then the number of beats per minute are measured at step 310 and encoded at step 312. For example, the number twenty-three could be represented by a pattern of two eighth notes followed by a triplet. Or a meter of ¾ could indicate that represented values are in the hundreds, with 412 heard as four sixteenths, one quarter-note, followed by two eighths. Because more than four within a beat may start to become too much, larger digit values such as digit values 5-9 could be encoded in other ways. For example, the number five could be encoded by a rhythmic pattern of a dotted-eighth note followed by sixteenth. Hence, each digit value is represented by a particular rhythmic pattern within one beat of time. This is just one example of how numbers could be encoded as specific data values using a hierarchical system as a reference for the encoding.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A system for communicating data within an environment to a listener, comprising:

a hierarchal music structure device, wherein said hierarchal music structure device specifies a Hierarchal Music Structure including at least one reference music parameter that defines reference music;

a data collector device, wherein said data collector device monitors at least one condition and provides data regarding the status of the at least one condition thereby identifying at least one monitored condition;

an analyzing device, wherein said analyzing device receives the data from said data collector device to detect the changing, steady state, or ongoing status of the at least one monitored condition;

a music generator device, wherein said music generator device translates the changing, steady state, or ongoing status of the at least one monitored condition to specify at least one data music parameter that defines data music; and an audio device for playing the reference music simultaneously with the data music, wherein the listener is trained to recognize and interpret the data music against the reference music to determine the changing, steady state, or ongoing status of the at least one monitored condition.

2. The system for communicating data within an environment to a listener according to claim 1 further comprising a storage device for storing the data music.

3. The system for communicating data within an environment to a listener according to claim 1, wherein the Hierarchical Music Structure includes at least one definition.

4. The system for communicating data within an environment to a listener according to claim 1, wherein the at least one reference music parameter is selected from the group comprising of key center, time, scale, meter, pitch, rhythm, timbre, tempo, beats, measure, meter, notes, loudness, space, harmony, phrase, and frequency.

5. The system for communicating data within an environment to a listener according to claim 1, wherein the at least one data music parameter is selected from the group comprising of key center, time, scale, meter, pitch, rhythm, timbre, tempo, beats, measure, meter, notes, loudness, space, harmony, phrase, and frequency.

6. The system for communicating data within an environment to a listener according to claim 3, wherein a modification to the at least one definition of the Hierarchical Music Structure thereby modifies the least one reference music parameter.

7. The system for communicating data within an environment to a listener according to claim 6, wherein the modification is a cyclic change.

8. The system for communicating data within an environment to a listener according to claim 1, wherein the reference music is aligned to the Hierarchical Music Structure.

9. The system for communicating data within an environment to a listener according to claim 8, wherein the data music is aligned to the reference music.

10. The system for communicating data within an environment to a listener according to claim 1, wherein the Hierarchal Music Structure establishes a grid in the frequency domain and the time domain against which the data can be measured by mapping the data as music components relative to the reference music.

11. The system for communicating data within an environment to a listener according to claim 1, wherein the data regarding the status of the at least one monitored condition is encoded into the data music.

12. A method for communicating data in an environment to a listener, comprising the steps of:

specifying a Hierarchical Music Structure including at least one definition to establish reference music;

monitoring at least one condition;

collecting data from said monitoring step;

analyzing the data from said collecting step;

encoding the data to define data music;

generating the reference music and the data music;

playing simultaneously the reference music and the data music; and determining by the listener the changing, steady state, or ongoing status of the at least one condition.

13. The method for communicating data in an environment to a listener according to claim 12, wherein said analyzing step further comprises the step of detecting the changing, steady state, or ongoing status of the at least one condition.

14. The method for communicating data in an environment to a listener according to claim 12, wherein said encoding step further comprises the step of establishing at least one data music parameter.

15. The method for communicating data in an environment to a listener according to claim 12, wherein said analyzing step further comprises the step of modifying the at least one definition of the Hierarchical Music Structure thereby modifying the reference music.

16. The method for communicating data in an environment to a listener according to claim 12, wherein said determining step further comprises the step of interpreting the data music against the reference music by the listener.

17. The method for communicating data in an environment to a listener according to claim 12, further comprising the step of recording at least one of the reference music and data music.

18. The method for communicating data in an environment to a listener according to claim 12, wherein the Hierarchal Music Structure establishes a grid in the frequency domain and the time domain against which the data can be measured by mapping the data as music components relative to the reference music.

* * * * *